US009580148B1

(12) United States Patent
Isaacs

(10) Patent No.: US 9,580,148 B1
(45) Date of Patent: Feb. 28, 2017

(54) LIGHTWEIGHT MARINE CRAFT AND METHODS THEREOF

(71) Applicant: Betta Boats LLC, Bay Saint Louis, MS (US)

(72) Inventor: Mark Isaacs, Bay Saint Louis, MS (US)

(73) Assignee: Betta Boats LLC, Bay Saint Louis, MS (US)

( * ) Notice: Subject to any disclaimer, the term of this patent is extended or adjusted under 35 U.S.C. 154(b) by 0 days.

(21) Appl. No.: 14/466,428

(22) Filed: Aug. 22, 2014

Related U.S. Application Data

(60) Provisional application No. 61/870,095, filed on Aug. 26, 2013.

(51) Int. Cl.

| | |
|---|---|
| ***B63B 5/24*** | (2006.01) |
| ***B63H 9/04*** | (2006.01) |
| ***B63B 41/00*** | (2006.01) |
| ***B63B 3/00*** | (2006.01) |
| ***B63B 9/06*** | (2006.01) |
| ***B63B 35/79*** | (2006.01) |

(52) U.S. Cl.
CPC . *B63B 5/24* (2013.01); *B63B 3/00* (2013.01); *B63B 9/06* (2013.01); *B63B 35/7906* (2013.01); *B63B 41/00* (2013.01); *B63H 9/04* (2013.01)

(58) Field of Classification Search
CPC ..... B63B 5/24; B63B 35/79; B63B 35/7906; B63B 35/73; B63B 35/81; B63B 35/815; B63B 35/817; B63B 1/00; B63B 35/7909; B63B 35/7943; A63C 5/03
USPC ..... 114/39.29, 352, 355, 357, 359; 441/35, 441/65, 74, 75
See application file for complete search history.

(56) References Cited

U.S. PATENT DOCUMENTS

| | | | | |
|---|---|---|---|---|
| 4,276,844 | A * | 7/1981 | Fremont | B63B 35/7909 114/357 |
| 5,275,860 | A * | 1/1994 | D'Luzansky et al. | 114/357 |
| 5,338,237 | A * | 8/1994 | Nealy | B63B 35/7933 441/74 |
| 5,421,283 | A * | 6/1995 | Bruggemann et al. | 114/357 |
| 5,807,152 | A * | 9/1998 | Wojcik | B63B 35/7906 114/357 |
| 6,042,439 | A * | 3/2000 | Parten | B63B 35/815 441/74 |
| 6,250,865 | B1 | 6/2001 | McSherry | |
| 6,283,058 | B1 | 9/2001 | Wiltrout et al. | |
| 7,438,618 | B1 * | 10/2008 | Lam | B63B 35/7906 441/74 |
| 8,702,458 | B2 * | 4/2014 | Preston | B63B 35/7943 114/55.56 |

* cited by examiner

*Primary Examiner* — Lars A Olson
(74) *Attorney, Agent, or Firm* — Middleton Reutlinger

(57) ABSTRACT

A boat hull or other marine structure is made by shaping a plastic foam core and covering it with a plastic outer skin glued in place by adhesive, mechanically fastened, or applied in liquid form. Minimal sawcuts to the foam core ease manufacture. Methods for anchoring fittings, masts, pipes and shade canopies are presented. No-sew sails for the boat have corners made of plastic sheet attached using both adhesive and mechanical fastening. Lateral resistance of the hull is provided by telescoping leeboards. A suite of these boats share the same modular masts and sails. Such boat hulls offer light weight, ease of transport, and unswampable buoyancy.

28 Claims, 8 Drawing Sheets

SECTION A-A

LIGHTWEIGHT MARINE CRAFT AND METHODS THEREOF

CROSS-REFERENCE TO RELATED APPLICATIONS

This Non-provisional application claims priority under 35 U.S.C. §119 (e) of U.S. Provisional Patent Application No. 61/870,095 filed Aug. 26, 2013, titled, "Lightweight Marine-craft and Methods Therefore", all of which is incorporated herein by reference.

BACKGROUND

Field of the Invention

Present embodiments relate to lightweight marine craft. More specifically, present embodiments generally relate to, without limitation, lightweight, low cost marine craft which may be modular to change design, size and capacity, as well as related methods therefore.

Description of Related Art

For almost 70 years, boat builders have used fiberglass fabric or fibers embedded in epoxy or polyester resin to make the hulls of boats, either formed in a mold, or laid up over a substrate structure such as a wood form or foam core. These molds and substrates, and the extensive labor required to apply and finish fiberglass, add to cost. While fiberglass boats have offered durability and other performance advantages compared to their wood or metal predecessors, they are still relatively heavy. More recently, carbon fiber has been used in place of fiberglass, lowering weight but adding cost.

Traditional boats are formed of fiberglass or carbon fiber construction and use two part polyester or epoxy resin with its relative heavy weight and high levels of volatile organic compounds (VOCs).

It would be desirable to overcome these and other issues related to the construction of marine craft in order to develop small lightweight marine craft which can be easily moved over land and quickly assembled for use.

The information included in this Background section of the specification, including any references cited herein and any description or discussion thereof, is included for technical reference purposes only and is not to be regarded subject matter by which the scope of the embodiments taught is to be bound.

SUMMARY

Present embodiments provide small marine craft and methods of building same. The marine crafts or boats are light enough to be easily transported by cartop or kayak cart, yet more affordable than fiberglass or most rotomolded polyethylene boats. The hull shape is either cut from a block of foam plastic (for example, polystyrene, polyurethane, or polyethylene foam), and/or laminated from sheets of such foam. The foam core is then covered with an outer plastic skin, such as films or sheets of polyethylene, polypropylene, PVC, PVA or liquid applied coatings including but not limited to polyurethane coatings. The plastic skin may be adhesive applied or applied as a liquid that dries.

Present embodiments differ from the traditional fiberglass or carbon fiber construction in that they do not use two (2) part polyester or epoxy resin with its relatively high weight and high levels of volatile organic compounds (VOCs). Further, present embodiments do not require heat in shaping nor curing as the hull may be shaped from a foam core block or sheet at room temperature using ordinary hand tools.

Present embodiments further simplify the manufacturing process of hulls by requiring the minimum number of saw cuts to shape the foam core. For non-limiting example, a six-cut hull results in a hydrodynamically efficient sailboat hull. Alternatively, a one-cut hull provides a flat-bottomed skiff suitable for electric motor sailing.

Attachments of deck fittings can be accomplished three ways, for example in one embodiment, a through-deck threaded rod, with or without a plastic sleeve, held in place with washers and nuts on the exterior skin of the boat. In a second embodiment, plastic plates with multiple metal screws connecting the plate to the deck, with the fitting attached to the plate. In a third embodiment, a through-deck rope or zip-tie typically lined with a plastic sleeve where it goes through the boat hull, tying the fitting to the boat hull.

No sew sails are described for such a boat made of fabric such as the thin high density polyethylene sheet commonly known as TYVEK, where corners may be made of laminating thicker plastic sheet to the fabric sheet, using adhesive and/or mechanical fastenings.

Masts and pipes can be held in place with part of their length inserted in a hole of the same diameter drilled in the hull. The outermost rigid plastic skin and optional interior horizontal layer(s) of rigid plastic skin provide lateral resistance for such masts and pipes. With just such a pipe connection, flexible cross-linked polyethylene (PEX) pipe can be used to form two arches, which may or may not cross, providing a frame for a sheet of flexible plastic to create a shade canopy, attached with machine screws and nuts to form either a barrel vault or hyperbolic paraboloid thin shell structure. Stayed masts can alternatively be deck stepped with the mast fitting into a hole of the same diameter in a plastic plate screwed into the deck skin with metal screws.

Lateral resistance for a sailboat hull can be provided by telescoping leeboards, one on each side of the hull, tied to the hull using the rope tie attachment described above. A weight on the lower leaf of the leeboard pulls that leaf downward, providing a deeper extension of the center of lateral resistance to reduce the pull to windward and the heeling moment on the hull. This lower leaf of the telescoping leeboard can be pulled up when sailing down wind or in shallow waters.

Embodiments based on this hull construction method offers a suite of hull shapes and sizes ranging from 8 feet long to 24 feet long in 4 foot increments that all share the use of the same modular mast and sail combinations. One mast type and 3 basic sail types can support the entire suite of rigs including, but not limited to: an 8 foot long catboat or sloop; a 12 foot long catboat, sloop or ketch; a sixteen foot long sloop, ketch or 3 masted schooner; a 20 foot long 3 masted schooner; or a 24 foot long 4 masted schooner. An alternate suite of hull sizes from 8 feet long to 24 feet long in 4 foot increments uses a modular staysail where one mast height and 3 sail sizes provide for an 8, 12, or 16 foot catboat, a 20 foot 2-masted staysail schooner, or a 24 foot 2-masted staysail schooner. Understanding that wind is not always available, such boat hulls can be powered by conventional marine electric motors run by batteries and/or photovoltaic panels.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the invention may be gleaned from the disclosure herein. Therefore, no limiting interpretation of this Summary is to be understood without further reading of the entire specification, claims, and drawings included herewith. A more extensive presentation of features, details, utilities, and advantages of the present invention is provided in the following written description of various embodiments of the invention, illustrated in the accompanying drawings, and defined in the appended claims.

BRIEF DESCRIPTION OF THE ILLUSTRATIONS

The above-mentioned and other features and advantages of this disclosure, and the manner of attaining them, will become more apparent and the lightweight marine craft and method thereof will be better understood by reference to the following description of embodiments taken in conjunction with the accompanying drawings, wherein.

Figure 5A:
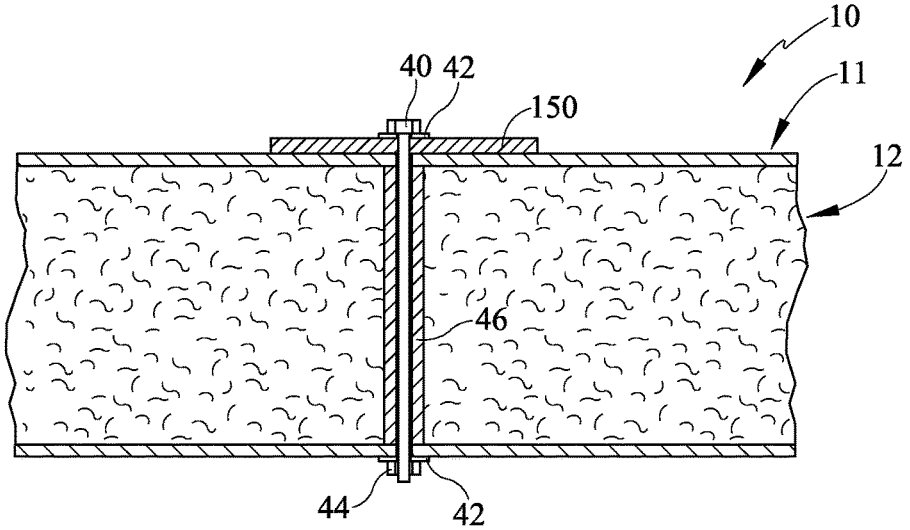
Figure 5B:
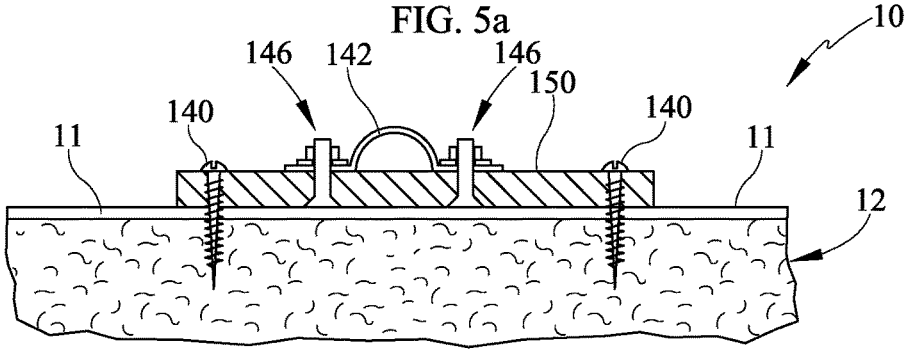
Figure 5C:
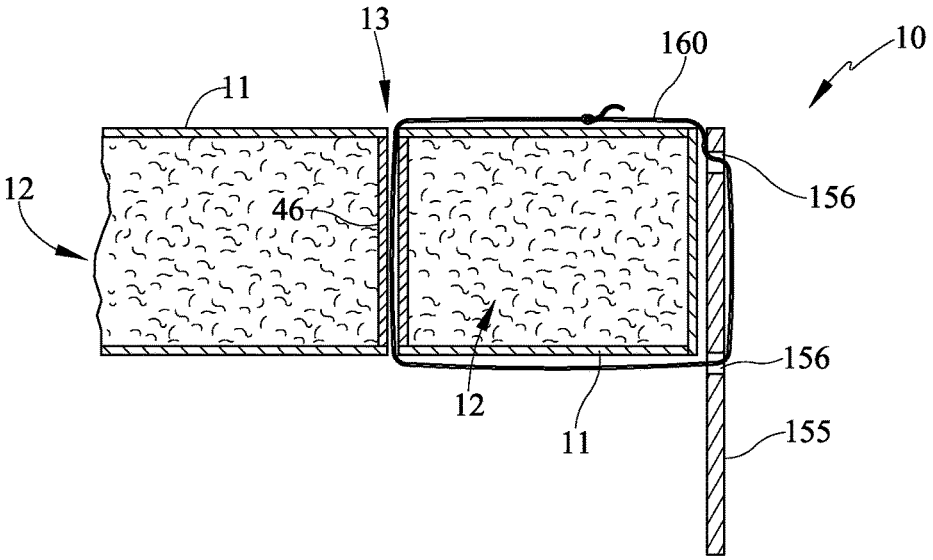
Figure 6:
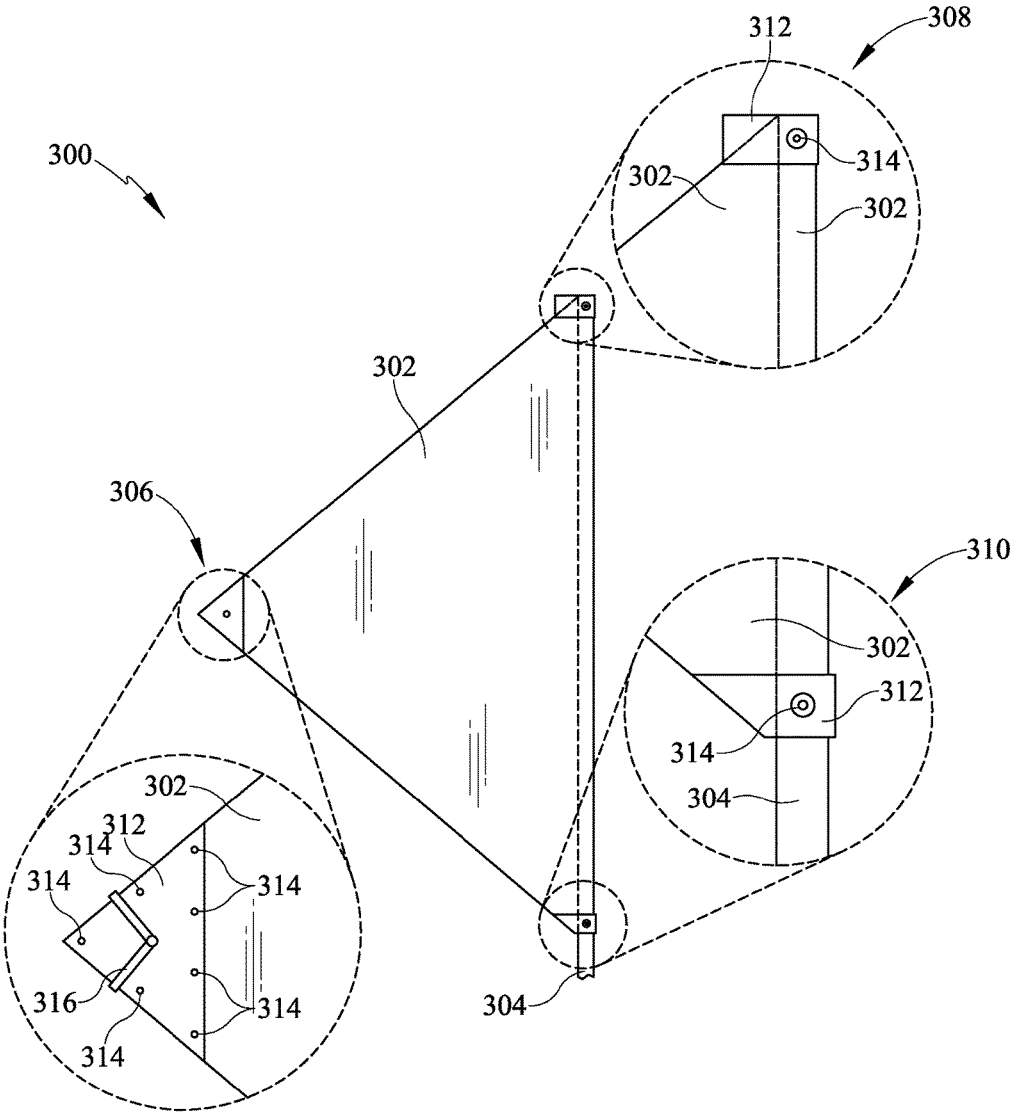
Figure 8:
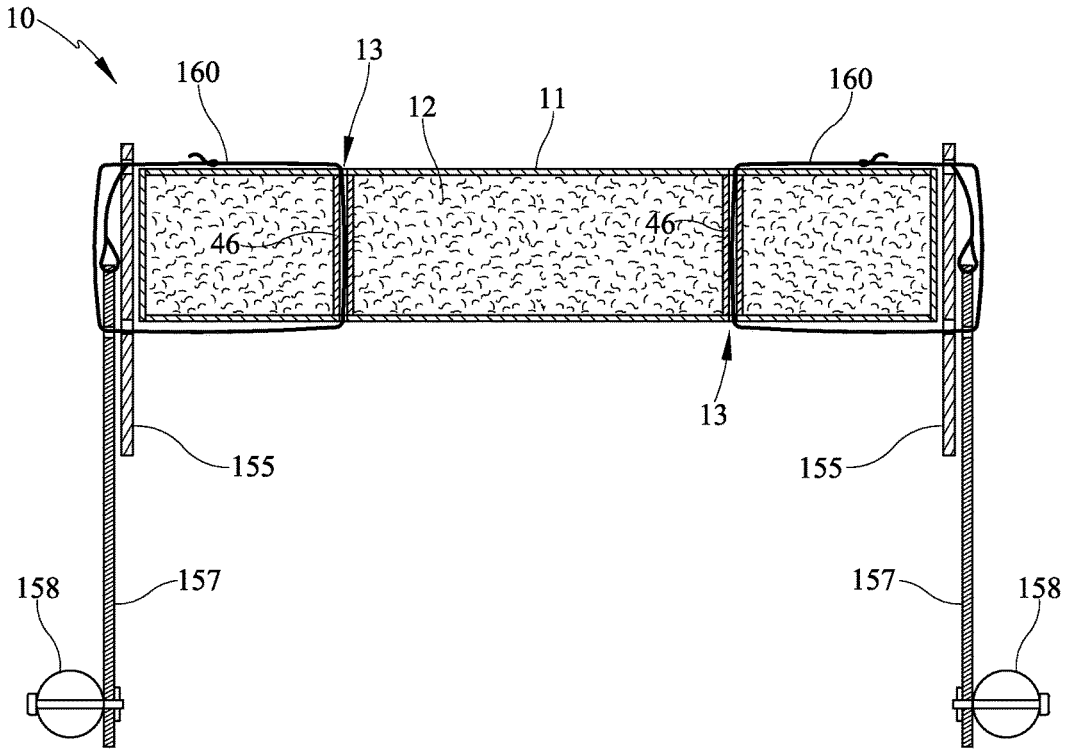
Figure 9A:
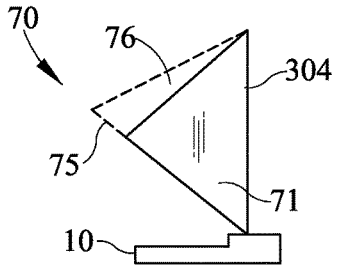
Figure 9B:
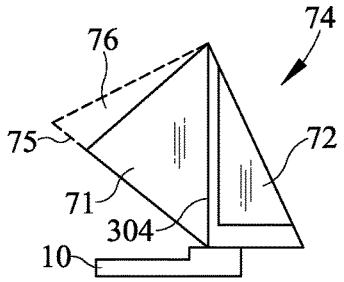
Figure 9C:
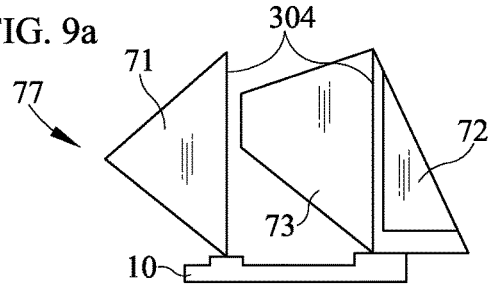
Figure 9D:
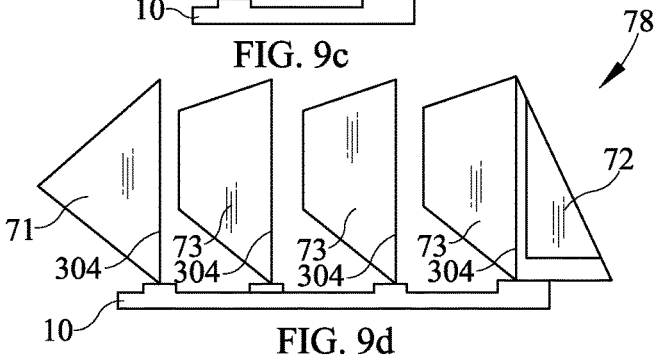
Figure 9E:
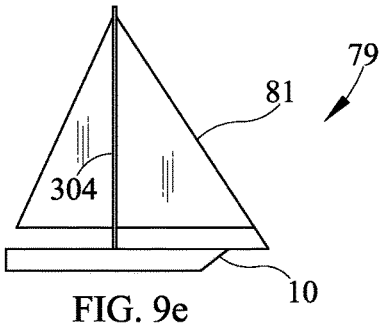
Figure 9F:
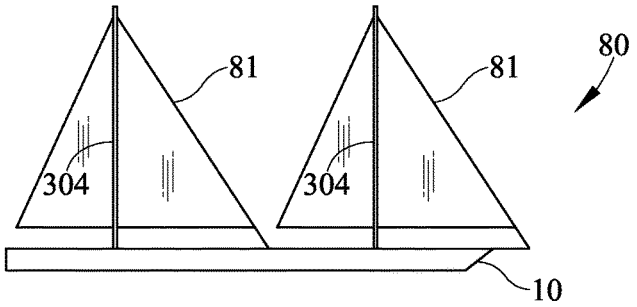
Figure 10:
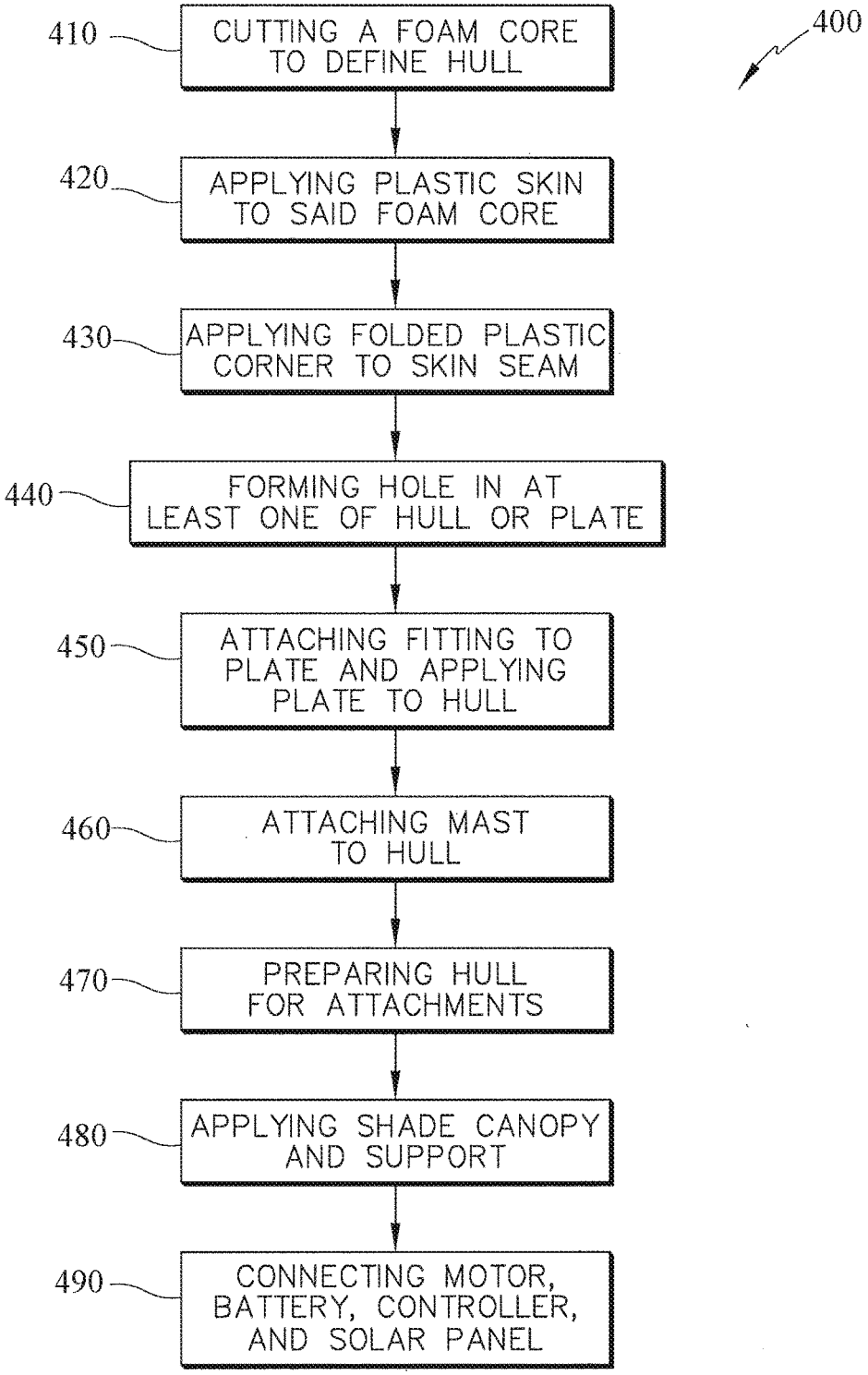

FIGS. 4*a-d* show six-cut and one-cut hull shapes, assuming one starts with a rectangular plank or billet of foam for the core of the hull;

FIGS. 5*a-c* show the three ways of attaching deck fittings;

FIG. 6 is a side view of a no-sew sail with detail view of various attachment points;

FIGS. 7*a-d* show mast and pipe attachment methods;

FIG. 8 shows the telescoping leeboards;

FIGS. 9*a-f* depict the two approaches to the modular nature of the marine craft to form various size and shaped crafts as well as various sail embodiments; and, FIG. 10 is a flow chart depicting a method of forming the light weight marine craft.

DETAILED DESCRIPTION

Reference now will be made in detail to embodiments provided, one or more examples of which are illustrated in the drawings. Each example is provided by way of explanation, not limitation of the disclosed embodiments. In fact, it will be apparent to those skilled in the art that various modifications and variations can be made in the present embodiments without departing from the scope or spirit of the disclosure. For instance, features illustrated or described as part of one embodiment can be used with another embodiment to still yield further embodiments. Thus it is intended that the present invention covers such modifications and variations as come within the scope of the appended claims and their equivalents.

Referring now to FIGS. 1-10, various embodiments of a lightweight marine craft are depicted including various methods of constructing the marine craft. The embodiments may be formed of lightweight foam materials which are covered with plastic or sprayed with a liquid-hardening plastic to form a skin. A variety of deck fittings may be utilized. Further, embodiments of various no-sew sails are also described. Finally, methods of construction are taught in this disclosure. This approach to shape and structure differs from previous boat building methods relying on frames (as in traditional wooden boats) or bulkheads stiffening thin-shell structures (such as typical fiberglass or carbon fiber hulls), and thickening of the hull structure at key points of loading (as found in both fiberglass, carbon fiber composite, and roto-molded polyethylene hulls).

Figure 1:
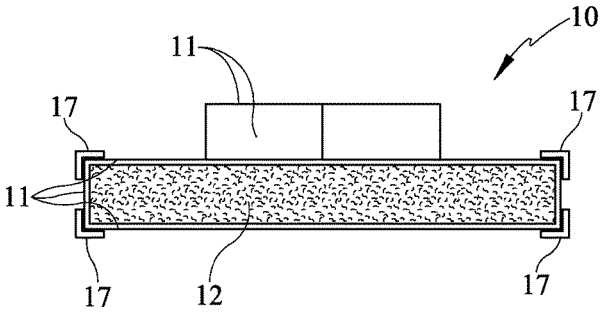
FIG. 1 is a sectional view of an exemplary boat hull.
Figure 2:
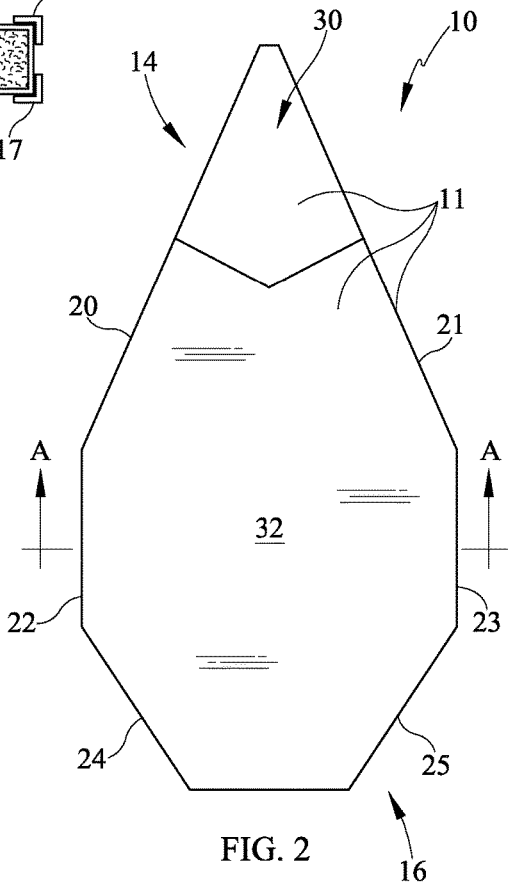
FIG. 2 is top view of the exemplary view of the marine craft of FIG. 1.

Referring now to FIG. 1, a sectional view of an exemplary hull 10 shown in FIG. 2. In the embodiment shown in FIG. 1, the boat is shown from the stern 16 located section cut looking forward toward the bow 14. The hull 10 comprises an outer plastic skin 11 which covers a monolithic foam core 12. The outer skin 11 may be formed of various materials including, but not limited to, polyurethane, polyethylene, polypropylene, PVC, PVA or liquid coatings. The skin 11 may be applied in various manners. For example, the skin 11 may be applied in sheet form with an adhesive or may be applied as a liquid that is sprayed on and dries. Additionally, corner guards 17 may be applied at corners where skins 11 meet. The guards 17 prevent peeling or other wear at seams where skins 11 abut.

The foam core 12 may be formed in a variety of ways and of different materials. For example, the foam core 12 may be cut from polystyrene, polyurethane or polyethylene. The foam core 12 may be easily cut with commonly used handtools, for example a hand saw. The plastic skin 11 may be applied to the core 12 either after the boat shape has been formed, or alternatively, may be applied to the foam core 12 and subsequently the core 12 and skin 11 may be cut to the desired hull shape. According to instant embodiments, the hull 10 is formed by cutting the core 12 and subsequently applying the skin 11 to the formed core 12 shape by way of mechanical fastener, adhesive or some other retaining feature or a combination thereof. The hull 10 has minimal cuts to define the shape and leaves the bottom substantially flat, according to this embodiment. However, this hull shape should not be considered limiting as others may be utilized.

Referring now to FIG. 2, a top view of the exemplary hull 10 is shown. The hull 10 has six sides in the embodiment depicted. The hull 10 may include three (3) surfaces 20, 22, 24 between the forward end and the rearward end on the port side and three (3) surfaces 21, 23, 25 on the starboard side. The surfaces may be formed by making cuts in the core 12 and plastic skin 11 with hand tools capable of making the formations in the hull 10. Additionally, the number of surfaces may vary depending on the shape of the hull desired, therefore other shapes may be utilized and the depicted embodiment should not be considered limiting.

At the bow 14 of the hull 10, the hull may have a step 30 having a higher elevation than a main deck 32. The step 30 may function at least in part as a splash guard. Additionally, the step allows deeper mast embedment and support if a mast is positioned therethrough. These steps 30 may vary in size from boat to boat depending upon the size of the hull 10 and the anticipated waves to be encountered based on sailing location and anticipated conditions. The step 30 may be formed of a single piece with the core defining the main deck 32 according to some embodiments. Alternatively, the step 30 may be formed of an alternate piece or pieces and either glued or fastened to the core 12 defining the main deck 32.

Figure 3:
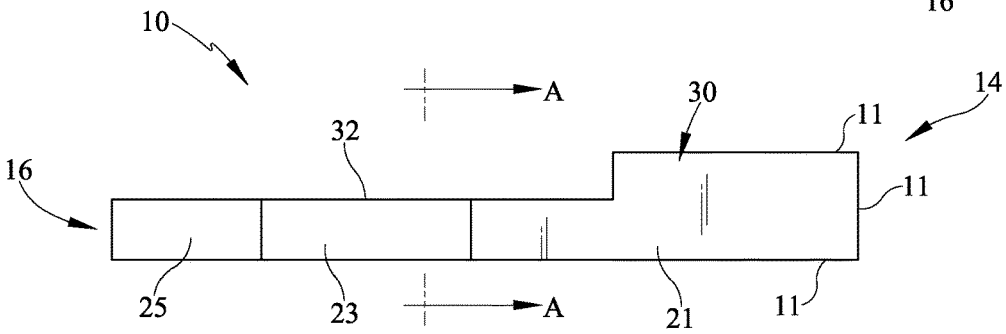
FIG. 3 is a side view of the marine craft of FIG. 2.

Referring now to FIG. 3, a side view of the exemplary hull 10 is depicted. The hull 10 is shown from the starboard side so that surfaces 21, 23 and 25 are shown. In this view, the main deck 32 is more clearly shown at a first height and a step 30 is shown at a higher elevation. However, the embodiment is exemplary in that the main deck 32 is shown at a lower elevation than the step 30. In other embodiments, the hull 10 may be of a single deck elevation or may have two or more deck elevations or steps. In other embodiments, the main deck 32 may be at a higher elevation and the step 30 may be at a lower elevation. Further, the step 30 may be moved to different locations rather than the bow 14 and may be located between the bow 14 and stern 16 or at the stern 16.

Figure 4A:
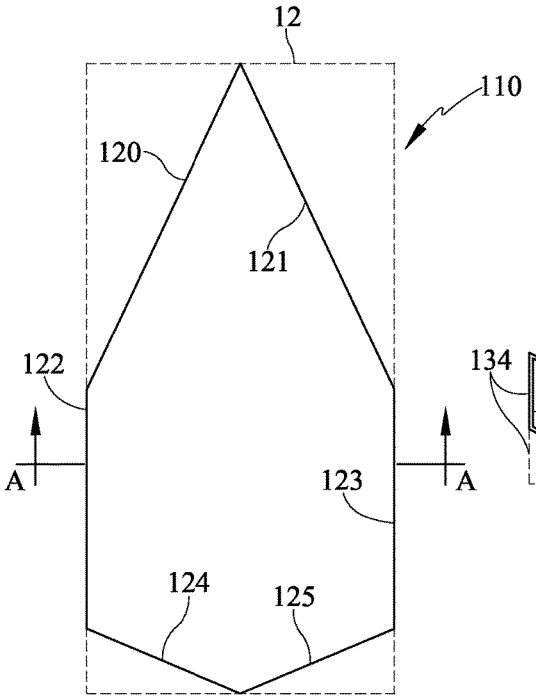

FIG. 4*a* depicts an exemplary six surface hull 110 which is formed of six cuts, for example with a hand saw. The foam core 12 is shown in broken line in its original form, for example a block form. The hull 110 includes two forward (bow) surfaces 120, 121, two central surfaces 122, 123 and two aft (stern) surfaces 124, 125. The forward and aft surfaces 120, 121, 124 and 125 are angled relative to the rectangular sides of the original foam core 12. The angled side surfaces 120, 121, 124, 125 may be formed with a number of handtools, automated or manual, which provide cutting function such as reciprocating or circular cutting tools.

Figure 4B:
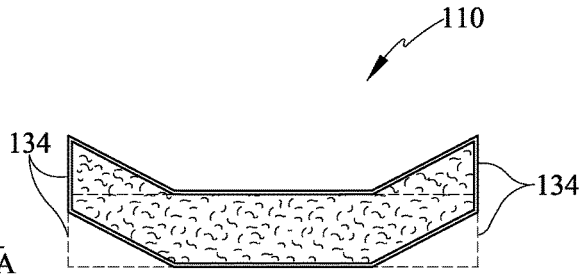

Referring now to FIG. 4*b*, the six-cut hull 110 of FIG. 4*a* is shown in a transverse section view. As depicted, the lower corners 134 may optionally be removed from the hull 110 by cutting the foam core 12. Upon cutting, the lower corners may be moved and adhered to the upper surface of the hull 110 to create a chined hull shape. This may be desirable in developing a more hydrodynamic shape to the hull 110 as well as to prevent items from sliding out of the boat hull 110 and limit splash water from entering the boat by raising the height of the sides. While the specific embodiment provides for six cuts to define the hull 110 shape, it should be understood that more than six cuts may be made to provide a desired shape of the hull 110, according to alternate embodiments.

Figure 4C:
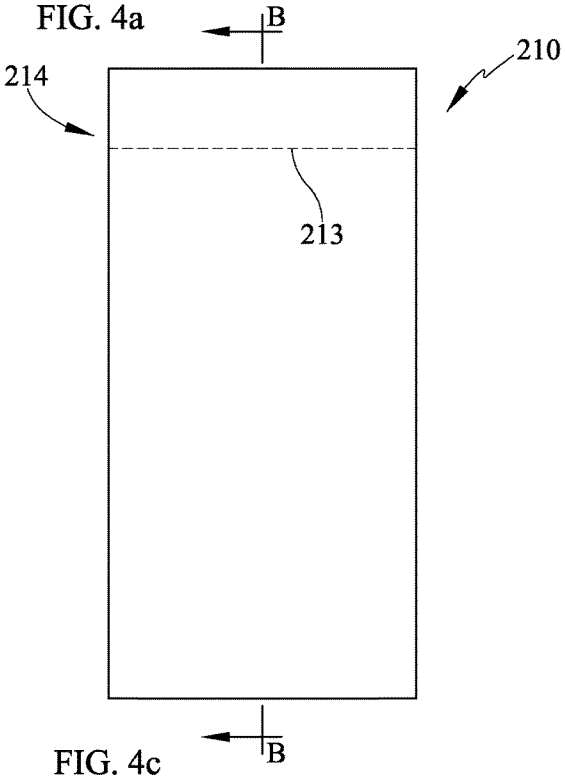
Figure 4D:
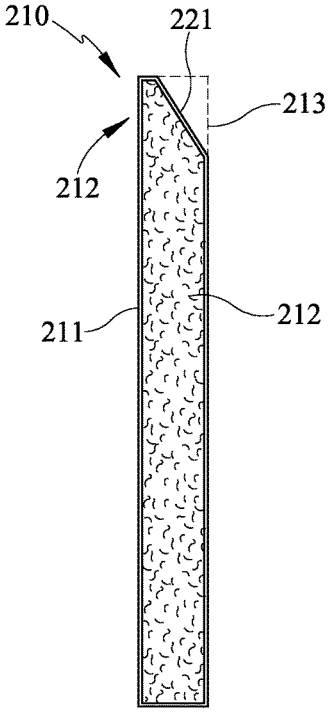

FIGS. 4*c*-4*d* also show a one-cut hull 210 in plan and longitudinal section views, respectively. The hull 210 may also be referred to more commonly as a flat bottom boat and is desirable for boating in areas with limited water depth or which are otherwise shallow. In this embodiment, the hull 210 is generally flat and formed of a block shape, such as a rectangle. However, various shapes may be utilized. At the front of the hull 210, the core 212 is cut 213 in a direction transverse to the longitudinal axis of the hull 210. The cut 213 is represented by a broken line in the plan view. In FIG. 4*d*, the cut 213 is also shown at the forward end or bow 214 of the hull 210 such that a flat angled surface 221 is formed, supporting the bow of the boat in moving across the top of the water. The surface 221 allows improved movement through the water during sailing or electric motor operation. In the section view of FIG. 4*d*, the core 212 is shown and wrapped with the skin 211. The various shapes of the hull in FIGS. 1-4 are all of varying hydrodynamic efficiency. Hydrodynamic efficiency is a measure of the movement of the hull through the water wherein the more efficient crafts move more easily through the water. In FIGS. 1-3 and 4*c*-4*d*, the hulls are flat bottomed primarily. However, the hull 110 of FIGS. 4*a*-4*b* shows how additional cuts may be made along the bottom, at an angle to the lateral edge to improve hydrodynamic efficiency. Referring now to FIGS. 5*a*-5*c*, various embodiments and methods of attaching fittings are shown. These fittings and related attachment methods may be used to join fittings to the hull 10, separate sections of hull 10 together, or alternatively, the fittings may be used to join plates to the hull 10, with fittings attached to those plates.

According to a first embodiment of FIG. 5*a*, a through-deck rod 40 may be utilized. In this embodiment, the hull 10 shown formed by the core 12 and includes a skin 11 wrapped about the core 12. In this embodiment, a through-deck threaded rod 40 extends through the skin 11, core 12 and through the opposite side of the hull 10. The threaded rod 40 is defined by a screw or other such fastener and includes a washer 42 at upper and lower ends thereof to engage the skin 11, or alternatively the core 12. The rod 40 may be threaded such that a nut 44 may be applied at the lower side of the hull 10 and against the washer 42. An insert or sleeve 46 may extend through the core 12 and provide a pathway for the rod 40 to pass there through. The insert 46 may be hollow in shape to allow passage of the rod 40 and may have various cross-sectional shapes. A plate 150 may be disposed on the upper surface of the core 12 or skin 11 and beneath the upper washer 42 to mount other items, such as masts, cables, ropes or shade structures described further herein.

Referring now to FIG. 5*b*, a second embodiment for connecting fittings is depicted in side section view. In this embodiment, a plate 150 is fastened to the core 12. The fasteners 140 may be of the self-tapping variety that extend into the core 12 and retain the plate 150 against the hull 10. The plate 150 further comprises at least one fastener 146 to retain a fitting 142 on an upper surface of the plate 150. The fitting 142 allows for retaining of various structures including tube, cable or rope structures by providing connection to the hull 10. These attachments and related methods allow attachment of fittings and equipment to the hull 10.

Referring now to FIG. 5*c*, a further alternative embodiment is depicted. In this embodiment, the hull 10 is again shown defined by a core material 12 covered on outer surfaces by a skin 11. The core 12 includes a hull hole 13 which is lined by a sleeve or insert 46. The hull hole 13 and sleeve 46 allow for passage of a rope, cable, zip-tie or the like 160. A leeboard 155 is located along a side exterior surface of the hull 10 and includes rope through holes 156 through which the rope or cable 160 may pass to connect the leeboard 155 to the hull 10. The leeboard 155 provides resistance to lateral movement or side slippage as the boat moves through the water. This may be used as an alternative to or in addition to a center keel or centerboard.

Referring now to FIG. 6, an elevation view of a no-sew sail 300 is depicted with various detail views also shown. The no-sew sail 300 may be formed of a fabric 302 such as high density polyethylene sheet, commonly known as TYVEK. The fabric 302 is positioned along a mast 304 that supports the sail 300. The sail 300 may be formed in various shapes in order to maximize the ability to utilize wind energy. In the exemplary embodiment, the sail 300 may be triangular in shape defined between corners 306, 308, 310.

Referring now to the first corner 306, the corner 306 is spaced from the mast 304 and the fabric 302, for example TYVEK may be laminated between two layers of a thicker plastic sheet or laminate 312. The laminate 312 may be glued to the fabric 302 or alternatively mechanically fastened with fasteners 314.

The corner 306 may further comprise one or more ropes 316 to provide points of attachment to the sail 300 commonly called sheets that adjust the angle of the sail 300 relative to the wind. The ropes 316 may be of a small diameter and may be formed of wire or twine based materials.

Referring still to FIG. 6, the second reinforced corner 308 is located at the top of the sail 300. In this embodiment a fastener 314 is utilized to retain the upper corner 308 of the sail 300 in position at the top of the mast 304. In other embodiments, the corner 308 may be slidable along the mast 304, allowing for attachment to a halyard for raising or lowering the sail 300. The corner 308 is similar to corner 306 in that the fabric 302 is laminated with a thicker plastic sheet 312 to reinforce the corner 308. The fastener 314 extends through both the fabric 302 and the laminate sheet 312.

Further, at the bottom of mast 304, the third corner 310 of the sail 300 is shown. The corner 310 is again formed of the fabric 302 with a thicker laminated layer 312 to strengthen the corner 310. In the depicted embodiment, a fastener 314 extends through the layer 312 and the fabric 302, and further passes through the mast 304. Alternatively, this corner may also slide along the mast 304 with a rope downhaul providing for adjustment of sail tension along the mast 304.

Referring to FIGS. 7*a*-7*d*, various views of connections for the mast 304 and shade supports 340 are depicted. In the side section view shown in FIG. 7*a*, the core 12 is shown with the outer skin 11 on upper and lower surfaces. The mast 304 extends through the skin 11 and into the core 12. Additional layers 15 of plastic material, may extend through the core 12 in order to provide additional holding power and rigidity for the mast 304. The layer 15 may be formed of various materials including but not limited to the material defining the skin 11.

Adjacent to the mast 304 is the shade support 340. The shade support 340 may be formed of lightweight tubing such as crosslinked polyethylene (PEX) or polyvinyl chloride (PVC) pipes which extend through the skin 11 and into the core 12. Due to the lightweight nature of the support 340, the tube may or may not be supported by the additional layer 15. The attachment methods provide a portion of length of mast 304 inserted into a hole of same diameter is drilled in the hull 10. The outermost rigid plastic skin 11 and optional interior horizontal layers 15 provide lateral resistance for such mast 304 and support 340.

Figure 7A:
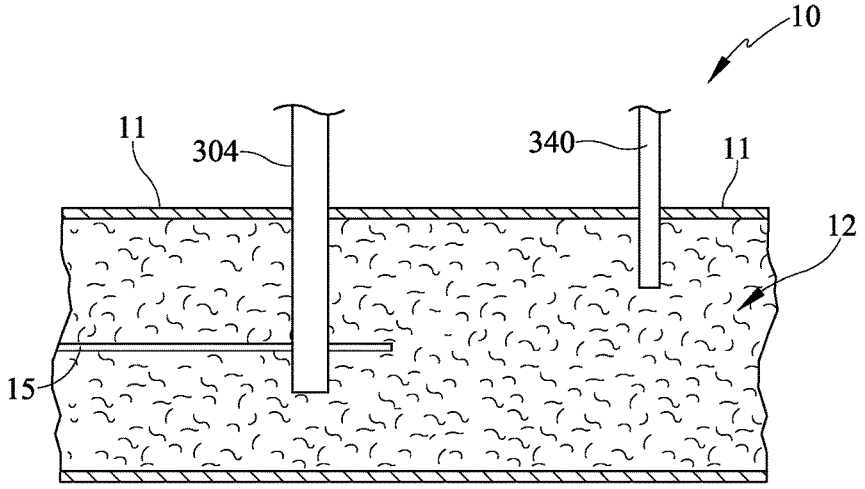
Figure 7B:
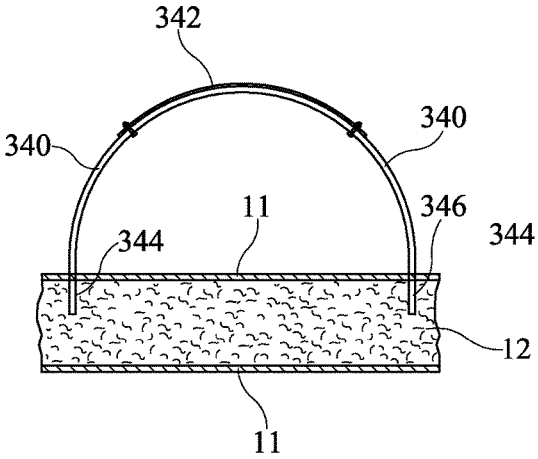

Referring now to FIG. 7*b*, a side section view is shown of an example shade support 340 and corresponding shade canopy 342. In the depicted view, the support 340 has a first end 344 and a second end 346 which extend into the core 12. This support forms a curvilinear shape along which the shade canopy 342 is positioned and stretched. A boat operator may rest in this shaded area provided by the lightweight tube structure 340 and the shade canopy 342. The material utilized to form the shade 342 may vary, but according to one embodiment may be a thin sheet of plastic material such as PVC which is lightweight and has good strength characteristics. This particular form is referred to as a barrel vault shade.

Figure 7C:
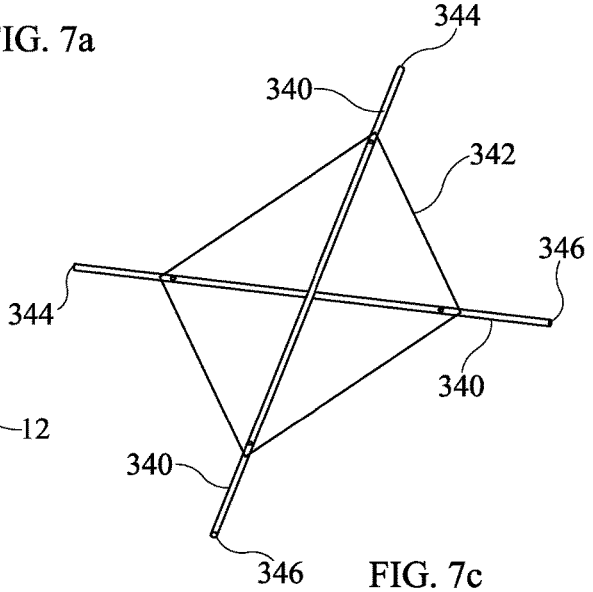

Referring now to FIG. 7*c*, a further alternative embodiment of a shade structure 340 is provided, for example, a hyperbolic paraboloid. The shade canopy 342 has a generally diamond or square shaped perimeter which is connected, for example by fasteners, to perpendicular supports or tube structures 340. When the ends of the tubes 344, 346 are curved and positioned into the core 12, the hyperbolic paraboloid shape of the shade canopy 342 is formed.

Figure 7D:
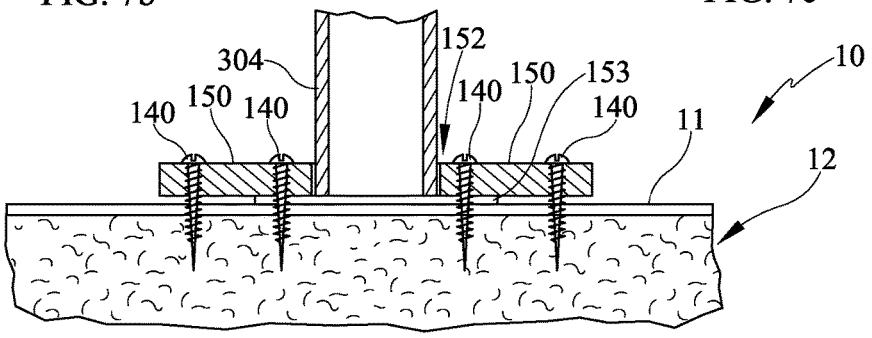

Referring now to FIG. 7*d*, a side section view of a further mounting option for a stayed deck stepped mast is depicted. A plate 150 is disposed on the outer surface of the hull 10 and is fastened to the core 12 by a plurality of fasteners 140. The plate 150 includes a hole 156 through which the mast 304 may be positioned.

The mast 304 may extend through the plate 150 and into the core 12 or, as shown, may extend to a lower plate 153 which inhibits the lower edge of the mast 304 from wearing a hole in the skin 11 and the core 12. The plate 150 and the lower plate 153 provide strength and lateral support to the mast 304. This attachment method may also be used for the support 340 shown previously.

Referring now to FIG. 8, an assembly for connecting leeboards to the exemplary hull 10 is depicted. As with previous embodiments, the hull 10 is formed of a core 12 and an outer skin 11. A hull hole 13 shown in two locations of the core 12 and skin 11. The hull holes 13 may be near lateral ends of the hull 10 so that the leeboards 155 may be connected at sides of the hull 10. A sleeve 46 may extend through the through hole 13. As with the embodiment of FIG. 5*c*, a rope or cable 160 extends through the hole 13 and wraps about the side of the hull 10.

The rope or cable 160 provides a structure for retaining the leeboards 155 against the ends of the hull 10. The embodiment further provides leeboard extensions 157 which are also connected by the rope 160 and to the leeboards 155. By loosening one end of the rope 160, the leeboard extensions 157 may be telescope into or out of the water, as desired. With the leeboard 155 and extension 157 extended, the boat has a greater lateral resistance to side slippage and can make better headway when sailing to windward, yet the leeboards 155 can be retracted as needed in shallow water or in sailing downwind when the lateral resistance is not needed.

Additionally, the leeboard extension 157 may also comprise a weighted structure 158 bolted, fastened, adhered or otherwise connected thereto. The weight 158 maintains some amount of stability for the leeboard extension 157. A weight 158 on the lower leaf of the leeboard extension 157 pulls the telescoping leeboard extension 157 down with a rope 160 capable of pulling the leeboard extension 157 up when desired.

FIGS. 9*a*-9*f* show various hulls 10 based on these construction methods offering a suite of hull shapes and sizes. The hulls 10 may range in length from, for non-limiting example, 4 feet long to 24 feet long in various increments. According to some embodiments, the increments may be 4 feet increments. The various hulls shown through the various FIG. 9*a*-9*f* embodiments all share use of the mast and sail designs of the previous embodiments. In some embodiments, the sails may be of differing shape but are generally constructed in the same or similar methods described previously herein. One mast type 304 and three basic sail shapes (71, 72 and 73) can support the entire suite of boats. According to FIG. 9*a*, a single sail catboat 70 is depicted. The catboat 70 may be of various lengths and one exemplary sail shape 71 is shown. Similarly, the two-piece mast 304 may telescope out to create larger sail plans or telescope so the two sections nest within themselves for compact carrying and storage. The relatively low mast height (10 feet in the current non-limiting embodiment) creates a lower center of effort for the sails, resulting in increased overall stability for the boat even when carrying full sail. The telescoping boom 75 allows for an optional larger mainsail 76 as shown in broken line. The telescoping boom 75 also enables the reefing of sails 71, 72 around the mast 304. According to an embodiment of FIG. 9*b*, a two sail sloop 74 is shown having a single mast 304. The sloop 74 may be of various lengths and includes the two sails 71, 72 which may differ in whole or in part from the sail 71 shown in FIG. 9*a*. According to the embodiment of FIG. 9*c*, a three sail ketch 77 is depicted having two masts 304. The central sail 73 is depicted as having an alternate shape from those in FIGS. 9*a*, 9*b*. Referring now to FIG. 9*d*, a multi-masted schooner 78 is shown having five sails 71, 72, 73 mounted on four masts 304. Three of the sails 73 are of substantially the same shape and size. The forward and rearward sails 71, 72 are depicted as types shown in the embodiments of FIGS. 9*a*-9*c*. Referring now to FIG. 9*e*, a single sail staysail catboat 79. Referring now to FIG. 9*f*, a multi-masted schooner 80 is depicted with staysails 81. The modular staysails 81 provide for a suite of staysail catboats 79 and two-masted staysail schooners 80.

According to some embodiments, a method 400 of constructing the marine craft of the various embodiments is also provided. With reference to FIG. 10, the method 400 utilizes a foam core to define a hull shape and provide buoyancy for the hull. The method comprises cutting 410 the foam core or block with six or fewer cuts to define a hull. Once the hull shape is defined by cutting the foam core, the plastic skin is applied 420 to the foam core. However, according to some alternative embodiments, the plastic skin may be applied first and the skin and foam cut at the same time.

Next, a folded plastic or corner guard is applied 430 to corner seams where the plastic skins meet. The corner guards may be folded plastic sheet or some other type of reinforced plastic to protect the seams of the skins from damage and from peeling away from the core. According to optional steps, the corner guards may be applied at all of the seams or various plastic skin seams.

Next a hole, also called a hull hole, is formed 440 through the plastic skin and into the foam core hull. The hole may be formed to receive a mast or a structure which may aid to provide shade. Additionally, or alternatively, the hole may be formed in a plate which will be subsequently applied to the top deck or a step of the hull.

A fitting may be attached 450 to the plate and the plate may be attached to the hull. The fitting may alternatively be applied to the plate after the plate is attached to the hull, depending in part on the method of attachment for the fitting.

Finally, the mast may be attached 460 to the hull.

Further, the hull may be prepared 470 for various attachments. For example, the hole forming may be by drilling or the holes may be molded in place when the foam core is formed. Additionally, the hole may be used for any of various attachments including, but not limited to, pipe sleeves, threaded rods, ropes and zip ties. The attachments may be used to attach fittings, motor mounts, bow spirits, or solar panels.

Further, a sail may be positioned or applied to the mast. This may be done with cords or ropes and may or may not include halyards to raise and lower the sail.

The hull may include a second hole for a shade canopy. The method may further comprise inserting a shade canopy pipe 480 into at least one second hole. Subsequently, the shade canopy is attached to the shade canopy pipe.

Additionally, one or more plates may be attached to the hull at the rear of the boat. The plate may be positioned on a top deck plastic skin. At least one of a battery and controller box may be attached to another or same plate at the middle or rear of the boat. One or more holes may be formed to provide motor mounts in the plate at the rear of the boat. The motor and battery may be wired together with a solar panel to charge the battery. A plastic skin may be placed over the wires and attached by various means including, but not limited to, fasteners. Any or all of these steps may occur as shown in step 490.

Further, it should be understood that these steps do not necessarily need to be performed in the order as provided but may be performed in some instance in other orders and still be within the scope of the inventive embodiments.

The foregoing description of structures and methods has been presented for purposes of illustration. It is not intended to be exhaustive or to limit the structures and methods to the precise forms and/or steps disclosed, and obviously many modifications and variations are possible in light of the above teaching. Features described herein may be combined in any combination. Steps of a method described herein may be performed in any sequence that is physically possible. It is understood that while certain forms of composite structures have been illustrated and described, it is not limited thereto and instead will only be limited by the claims, appended hereto.

While multiple inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Examples are used to disclose the embodiments, including the best mode, and also to enable any person skilled in the art to practice the apparatus and/or method, including making and using any devices or systems and performing any incorporated methods. These examples are not intended to be exhaustive or to limit the disclosure to the precise steps and/or forms disclosed, and many modifications and variations are possible in light of the above teaching. Features described herein may be combined in any combination. Steps of a method described herein may be performed in any sequence that is physically possible.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

What is claimed is:

1. A lightweight marine craft, comprising: a hull having a plastic foam core and covering formed of a plastic outer skin that is free of two part epoxy or polyester resins, said plastic outer skin being one of glued in place by adhesive, mechanically fastened, applied in liquid form to dry in place, or a combination thereof, further comprising attachments passing through said hull comprising at least one of a pipe sleeve, through-deck threaded rod, rope, cable or a zip-tie to attach a fitting to said hull, further comprising a deck stepped mast placed in a hole cut through a deck mounted plate.

2. The lightweight marine craft of claim 1 wherein said foam core provides a hull shape and buoyancy.

3. The lightweight marine craft of claim 2 having six or fewer saw cuts to form said hull shape.

4. The lightweight marine craft of claim 1 further comprising a plate attached to a fitting, said plate screwed to said outer skin of said hull.

5. The lightweight marine craft of claim 1 further comprising no-sew sails formed of a high density polyethylene sheet with corners reinforced with plastic sheet material.

6. The lightweight marine craft of claim 5 further comprising a hull hole formed partially through said hull and a mast inserted into said hull hole.

7. The lightweight marine craft of claim 1 further comprising a hull hole formed in said hull and a flexible pipe frame in said hull hole for a shade canopy.

8. The lightweight marine craft of claim 1 further comprising a leeboard along a side of said hull.

9. The lightweight marine craft of claim 8 further comprising a telescoping leeboard to provide deeper extension for lateral resistance when sailing to windward.

10. The lightweight marine craft of claim 9 wherein said telescoping leeboard is retractable when sailing down wind or in shallow water.

11. The lightweight marine craft of claim 1 wherein a suite of boats of various lengths is made possible by a single mast type and three or less sail types.

12. The lightweight marine craft of claim 11 wherein said suite of boats includes at least one of a single sail catboat, a two sail sloop, a three sail ketch or a multiple masted schooner.

13. The lightweight marine craft of claim 11 wherein said suite of boats further comprises a staysail schooner with two or more sails.

14. The lightweight marine craft of claim 1 wherein said lightweight marine craft is powered by a conventional marine electric motor run by batteries and/or photovoltaic panels.

15. A method of constructing a light weight marine craft, comprising the steps of:

cutting a foam core to define a hull shape;

applying a plastic skin to said foam core;

forming a hole in said hull for attachments, wherein said attachments include at least one of a pipe sleeve, a threaded rod, a rope, or a zip-tie; and, attaching at least one fitting to a plate and applying said plate to said foam core and said plastic skin.

16. The method of claim 15 further comprising attaching corner protection plastic at seams where said plastic skins meet.

17. The method of claim 15 wherein said attachments may be used for attaching fittings, motor mount, bow spirit or solar panel.

18. The method of claim 15 further comprising applying a sail to said mast.

19. The method of claim 15 further comprising drilling at least one second hole for a shade canopy.

20. The method of claim 19 further comprising inserting shade canopy pipe into said at least one second hole.

21. The method of claim 20 further comprising attaching said shade canopy to said shade canopy pipe.

22. The method of claim 15 further comprising attaching fittings to said plate and then fastening said plate to a top surface of said hull.

23. The method of claim 15 further comprising forming mount motor holes in plates attached to said hull at a rear end of said hull.

24. The method of claim 23 further comprising mounting a battery and controller boxes to plate attached to top deck plastic skin.

25. The method of claim 24 further comprising wiring said motor to said battery and a solar panel to charge said battery.

26. The method of claim 25 further comprising using fasteners to attach a plastic skin covering wires from motor to battery.

27. A lightweight marine craft, comprising: a hull having a plastic foam core and covering formed of a plastic outer skin that is free of two part epoxy or polyester resins, said plastic outer skin being one of glued in place by adhesive, mechanically fastened, applied in liquid form to dry in place, or a combination thereof, further comprising attachments passing through said hull comprising at least one of a pipe sleeve, through-deck threaded rod, rope, cable or a zip-tie to attach a fitting to said hull, wherein said lightweight marine craft is powered by a marine electric motor run by at least one of a battery or a photovoltaic panel.

28. A lightweight marine craft, comprising: a hull having a plastic foam core and covering formed of a plastic outer skin that is free of two part epoxy or polyester resins, said plastic outer skin being one of glued in place by adhesive, mechanically fastened, applied in liquid form to dry in place, or a combination thereof, further comprising attachments passing through said hull comprising at least one of a pipe sleeve, through-deck threaded rod, rope, cable or a zip-tie to attach a fitting to said hull, further comprising a hull hole formed partially through said hull and a mast inserted into said hull hole.

* * * * *